United States Patent [19]

Iida

[11] Patent Number: 4,870,466

[45] Date of Patent: Sep. 26, 1989

[54] CLEANING DEVICE HAVING FUR BRUSH, SCAVENGER ROLLER AND SCRAPER FOR ELECTROSTATIC RECORDER

[75] Inventor: Haruki Iida, Nagareyama, Japan

[73] Assignee: Ricoh Company, Ltd., Tokyo, Japan

[21] Appl. No.: 127,222

[22] Filed: Dec. 1, 1987

[30] Foreign Application Priority Data

Dec. 3, 1986 [JP] Japan ..... 61-289539

[51] Int. Cl.[4] ..... G03G 21/00

[52] U.S. Cl. ..... 355/297; 355/302; 355/303; 15/1.5 R; 15/256.51

[58] Field of Search ..... 355/15, 296, 297, 302, 355/303; 118/652; 430/125; 15/1.5 R, 256.5, 256.51, 256.52

[56] References Cited

U.S. PATENT DOCUMENTS

| | | | |
|---|---|---|---|
| 3,572,923 | 3/1971 | Fisher et al. | 355/15 |
| 4,297,021 | 10/1981 | Tani et al. | 355/15 X |
| 4,469,435 | 9/1984 | Nosaki et al. | 355/15 |
| 4,506,975 | 3/1985 | Shukuri et al. | 355/15 |
| 4,588,285 | 5/1986 | Tagoku | 355/15 |

FOREIGN PATENT DOCUMENTS

| | | | |
|---|---|---|---|
| 57-64276 | 4/1982 | Japan | 355/15 |
| 58-44477 | 3/1983 | Japan | 355/15 |
| 60-101575 | 6/1985 | Japan | 355/15 |
| 61-212880 | 9/1986 | Japan | 355/15 |
| 991360 | 1/1983 | U.S.S.R. | 355/15 |

OTHER PUBLICATIONS

*Xerox Disclosure Journal*, vol. 1, No. 6, Jun. 1976, Friday, Bruce W., "Device for Reducing Fiber Matting in Xerographic Cleaning System", p. 85.

*Primary Examiner*—Arthur T. Grimley
*Assistant Examiner*—J. Pendegrass
*Attorney, Agent, or Firm*—Cooper & Dunham

[57] ABSTRACT

A cleaning device for removing residual toner and paper dust from a photoconductive element of an electrophotographic copier includes a fur brush for removing the residual toner and paper dust in contact with the photoconductive element after the latter has been precharged. Then, a scavenger roller collects the toner and paper dust from the fur brush and, then, a scraper scrapes off the toner and paper dust from scavenger roller. The scavenger roller has surface roughness which is equal to or less than 0.5 μm. An AC voltage is applied to the scavenger roller as a cleaning bias voltage. At least two flickers are provided for shaking off the toner and paper dust from the fur brush together with or independently of the scavenger roller. The fur brush and the scavenger roller are rotated in opposite directions to each other, and the peripheral speed of the scavenger roller is higher than that of the fur brush as measured at their point of contact. A cleaning blade is located at a position downstream of the fur brush so that is constantly scrapes off some amount of toner, whereby a frictional force acting between the cleaning blade and the surface of the photoconductive element is maintained weak enough to eliminate wear and damage.

11 Claims, 3 Drawing Sheets

DASHED LINES: PRIOR ART

CLEANING DEVICE HAVING FUR BRUSH, SCAVENGER ROLLER AND SCRAPER FOR ELECTROSTATIC RECORDER

BACKGROUND OF THE INVENTION

The present invention relates to a cleaning device applicable to an electrophotographic copier, a laser printer, a facsimile apparatus and other electrostatic recorders for removing toner which remains on an image carrier, i.e. photoconductive element.

In an electrophotographic copier, for example, a latent image electrostatically formed on a photoconductive element is developed to become a toner image and, then, the toner image is transferred to a paper sheet and fixed thereon. Since some toner and paper dust remain on the surface of the photoconductive element after the transfer of the toner image to a paper sheet, the copier has to be equipped with a cleaning device for removing them before the next image is formed. One of various kinds of cleaning devices heretofore proposed includes a precleaning charger for discharging toner remaining on the photoconductive element, or residual toner, a fur brush for removing the residual toner from the photoconductive element, and a single flicker for beating down the toner from the fur brush penetrating into the latter. Another cleaning device known in the art includes a scavenger roller, or collecting roller, for collecting toner from a fur brush, and an elastic scraper for scraping off the toner from the scavenger roller. Usually, such cleaning devices further include a cleaning blade for removing that part of toner which fails to be removed even by the fur brush.

The residual toner remaining on a photoconductive element usually contains impurities, typically paper dust. When paper dust is caught between the scavenger roller and the edge of the scraper, the cleaning ability of the scavenger roller which acts on the fur brush is reduced resulting that the residual toner partly fails to be scraped off. Especially, since the toner is electrically insulative, the paper dust degrades the electrical effect of the scavener roller on the fur brush to thereby impair the toner removing ability of the fur brush, eventually causing a copy sheet to be smeared due to incomplete cleaning.

In a modern electrophotographic copier and others, the increase in copying speed is accompanied by the increase in the amount of toner and paper dust which remain on the photoconductive element and, therefore, adhere to the fur brush. Such an amount of residual toner and paper dust is beyond the ability of a single flicker which makes contact with the fur brush. Even the scavenger roller is incapable of fully collecting the residual toner and paper dust from the fur brush. In this situation, the residual toner and paper dust left unremoved from the fur brush are transported onto the photoconductive element again so that they reach the edge of the cleaning blade together with toner and paper dust which have not been removed by the fur brush. Since some toner is allowed to move past the cleaning blade and leak due to vibrations and others, the toner is in due course scattered at a location downstream of the cleaning device with respect to an intended direction of rotation of the photoconductive element. This part of toner adheres to the photoconductive element, an optical arrangement and others to lower the quality of images. Further, the paper dust wedged between the cleaning blade and the photoconductive element impairs the function of the cleaning blade and, thereby, causes black stripes to appear on a copy sheet while scratching the photoconductive element.

An implementation heretofore proposed for the effective collection of toner from the fur brush consists in applying a DC bias to the scavenger roller. However, a difficulty has been experienced in collecting the toner of the opposite polarity to the DC bias as well as paper dust. In the light of this, it has also been proposed to switch the polarity of the DC bias applied to the scavenger roller. This scheme is not fully satisfactory for the following reason. When, for example, a DC bias of positive polarity is applied to the scavenger roller, residual toner and paper dust which have been charged to the positive polarity cannot be collected although those charged to the negative polarity may be collected. When a DC bias of negative polarity is applied to the scavenger roller, toner and paper dust charged to the negative polarity fail to be collected. Such residual toner and paper dust left uncollected are allowed to adhere to the photoconductive element again, resulting in the previously stated problem.

Another problem with the fur brush is that while it is in contact with the photoconductive element and the flicker, its hairs are constantly affected by a force which tends to lay them in a particular direction corresponding to the rotating direction of the photoconductive element of the fur brush. Therefore, after a long time of use, the hairs of the fur brush become unable to regain their original position resulting that the outside diameter of the fur brush and, therefore, the degree or area of contact of the fur brush with the photoconductive element is reduced to aggravate the cleaning ability.

On the other hand, in a cleaning device of the kind described, an excessive cleaning ability, especially that of the fur brush, brings about another problem as follows. When the ability of the fur brush is excessive, the amount of residual toner and paper dust which is expected to reach the cleaning blade is extremely reduced. In this condition, the frictional force acting between the cleaning blade and the photoconductive element is intensified to allow the edge of the cleaning blade to wear soon. While the amount of residual toner transported to the cleaning blade may be increased by lowering the cleaning ability of the fur brush, such an approach would lower the total performance of the cleaning device. Another approach which may be contemplated to slow down the wear of the edge of the cleaning blade is reducing the pressure force which is exerted by the cleaning blade to the photoconductive element. Simply reducing the pressure force, however, would cause the cleaning blade to oscillate and produce noise. Although a lubricant or the like may be applied to the photoconductive element in a position upstream of the cleaning blade, i.e., between the fur brush and the cleaning blade, such a scheme is impracticable without complicating the construction. Further, to increase the amount of toner to reach the cleaning blade, an arrangement may be made such that a particular pattern provided in an ineffective image area of a glass platen is exposed and developed but not transferred to a paper sheet, i.e., it just contributes to the supply of non-transferred toner. This scheme, too, complicates the construction of the entire copier and causes the amount of development to scatter over a substantial range due to variations of the optical system and photoconductive element with time.

SUMMARY OF THE INVENTION

It is, therefore, an object of the present invention to provide a cleaning device for an electrophotographic copier and others which has an improved ability to remove residual tone and paper dust from a photconductive element.

It is another object of the present invention to provide a cleaning device for an electrophotographic copier and others which prevents residual toner from leaking and scattering around.

It is another object of the present invention to provide a cleaning device for an electrophotographic copier and others which protects a photoconductive element against damage.

It is another object of the present invention to provide a cleaning device for an electrophotographic copier and others which extends the service life of a fur brush and that of a cleaning blade to maintain a stable cleaning ability a long period of time.

It is another object of the present invention to provide a cleaning device for an electrophotographic copier and others which efficiently collects residual toner and paper dust from a fur brush.

It is another object of the present invention to provide a generally improved cleaning device for an electrophotographic copier and others.

A cleaning device installed in an electrophotographic recorder for removing residual toner which remains on a surface of a rotatable image carrier for carrying an electrostatic latent image thereon of the present invention comprises a fur brush rotatable in a predetermined direction in contact with the surface of the image carrier for removing the residual toner, a scavenger roller rotatable in a predetermined direction in contact with the fur brush for collecting the residual toner from the fur brush, and a scraper held in contact with the scavenger roller for scraping off the residual toner collected.

The above and other objects, features and advantages of the present invention will become more apparent from the following detailed description taken with the accompanying drawings.

DESCRIPTION OF THE PREFERRED EMBODIMENT

Figure 1:
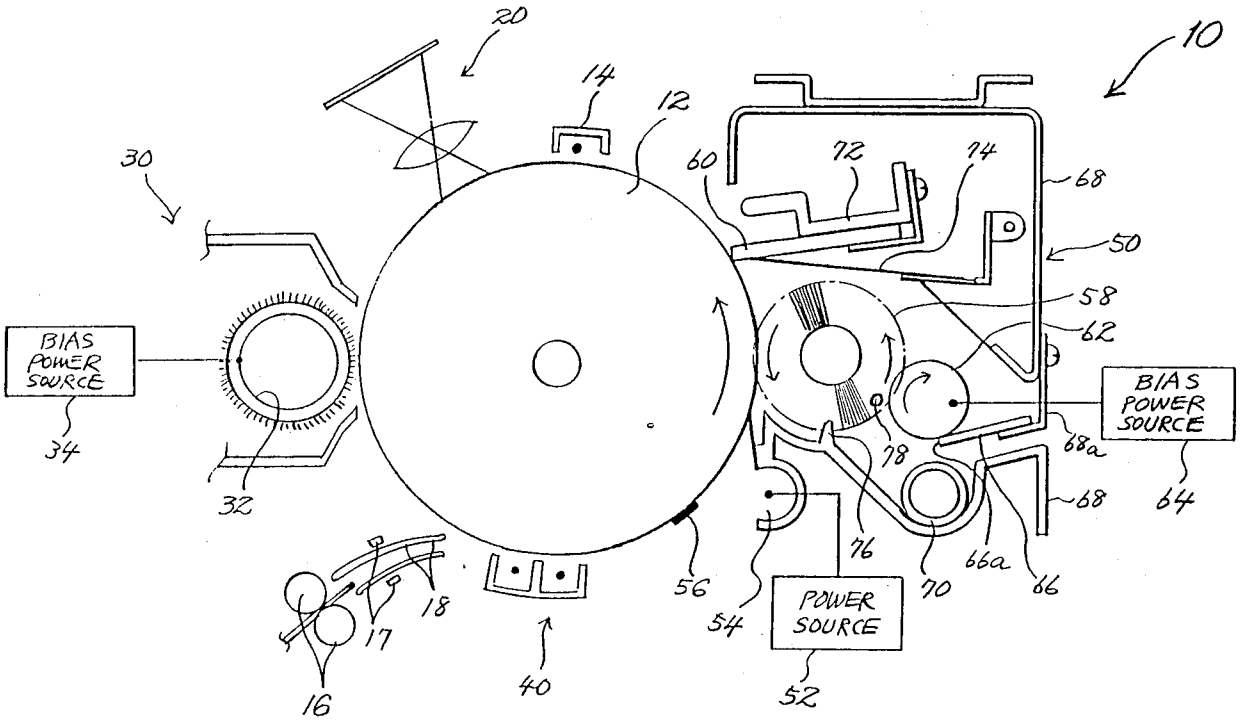
FIG. 1 is a sectional side elevation showing a cleaning device in accordance with the present invention.

Referring to FIG. 1 of the drawings, there are shown an electrophotographic copier 10 which includes a photoconductive element, or image carrier, 12, an optical arrangement 20 for exposure, a developing device 30 and a transferring device 40 which are arranged around the photoconductive element 12, and a cleaning device 50 which embodies the present invention. The surface of the photoconductive element, or drum, 12 which is rotated as indicated by an arrow in the figure is charged by a charger 14 and, then, exposed imagewise by the optical arrangement 20 to electrostatically form a latent image thereon. The latent image is developed by, for example, a magnetic brush 34 developed on a developing sleeve 32 which is included in the developing device 30. The resulting toner image is transferred to a paper sheet which is fed from a sheet feeder, not shown, to the transferring device 40 by way of a register roller pair 16 and a guide 18. After the transfer of the toner image, some toner which did not contribute to the development remains on the drum 12 and is transported to the cleaning device 50. The paper sheet with the toner image is driven by a paper transport belt to a fixing device, so that the toner image is fixed by a fixing roller of the fixing device. The paper sheet coming out of the fixing device is advanced by discharge rollers to a copy tray. A bias voltage of predetermined polarity is applied from a developing bias power source 34 to the developing sleeve 32. A register sensor 17 is associated with the guide 18.

The cleaning device 50 in accordance with the present invention includes a precleaning charger 54 which is connected to a power source 52 and located in the most upstream side of the device 50 with respect to the direction of rotation of the drum 12. The precleaning charger 54 is adapted to discharge (or charge) residual toner 56 which is left on and transported by the drum 12, before the drum 12 is cleaned. Sequentially arranged in the cleaning device 50 are a conductive fur brush 58 and a cleaning blade 60 each of which makes contact with the drum 12. While the conductive fur brush 58 in rotation serves to remove the residual toner 56 from the drum 12, the cleaning blade 60 functions to remove that part of the toner 56 which has failed to be removed by the fur brush 58.

A scavenger roller 62 is connected to a cleaning bias power source 64 and rotated in contact with the fur brush 58. The scavenger roller 62 comprises a conductive member which is coated with an insulating film. A cleaning bias voltage is applied from the bias power source 64 to the scavenger roller 62. A scraper 66 is held in contact with the scavenger roller 62 to serve as an elastic blade member. The scraper 66 may advantageously be implemented with an insulative sheet such as a polyester sheet or with a rubber blade. Supported by a part **68*a* of a casing 68, the scraper 66 has an edge 66*a* which abuts against the lower end of the scavenger roller 62. Located below the scraper 66 and scavenger roller 62 is a transport screw or transport coil 70. The cleaning blade 60 is rotatably supported by a holder 72 while a blade cleaner 74 is held in contact with the edge of the cleaning blade 60** from below.

In operation, the residual toner 56 left on the drum 12 after image transfer is discharged or charged by the precleaning charger 54 and, then, removed by the fur brush 58 from the surface of the drum 12. This part of the residual toner 56 is transferred from the fur brush 58 to the scavenger roller 62 and, then, scraped off by the scraper 66. Then toner 56 dropped from the scavenger roller 62 by the scraper 66 is transported by the screw or coil 70 to the outside of the cleaning device 50.

The process for the residual toner 56 is to transported from the drum 12 to the scavenger roller 62 is as follows. First, a voltage of the same polarity as the toner 56 is applied to the precleaning charger 54. On the other hand, a voltage of the opposite polarity to the charger 54 is applied to the scavenger roller 62 which is conductive. Hence, a voltage of the same polarity as the scavenger roller 62 is induced in the fur brush 58, but it is lower than the voltage applied to the scavenger roller 62 with respect to the potential. In this condition, the toner 56 is transferred from the drum 12 to the fur brush 58 by electrostatic induction and, therefrom, to the scavenger roller 62 by electrostatic induction. Specifically, although the fur brush 58 and the scavenger roller 62 are the same in polarity, the toner 58 is transported as stated above due to the difference in potential.

As regards the toner 56, it is charged by the precleaning charger 54 based on a charge injection principle and not on any other principle. It, therefore, may be said that the toner 56 once charged by the precleaning charger 54 does not undergo any polarity inversion thereafter.

Impurities such as dust produced from paper sheets are often deposited on the drum 12 together with the residual toner 56. Such paper dust, like the toner 56, is removed by the fur brush 58 and transported to the scavenger roller 62. Most of the paper dust is scraped off from the scavenger roller 62 by the scraper 66. However, a part of the paper dust becomes wedged between the scavenger roller 62 and the edge **66*a* of the scraper 66 to lower the cleaning ability of the scavenger roller 62. When the ability of the scavenger roller 62 is lowered to be locally left non-scraped by the scraper 66, the electric induction from the scavenger roller 62 to the fur brush 58 is prevented because the toner itself is insulative. As a result, the potential difference between the residual toner 56 charged by the precleaning charger 54 and the fur brush 58 is reduced to zero so that the electrostatic induction to the fur brush 58** is disenabled to cause incomplete cleaning.

Presumably, the deposition of paper dust between the scavenger roller 62 and the edge **66*a* of the scaper 66 is ascribable to fine vibration of the scraper 66, wear of the edge 66*a*, and others. While, for example, the condition of contact of the scraper 66 with the scavenger roller 62 may be changed, such is not effective and, rather, brings the edge 66*a*** into an abnormal state and/or aggravates its wear.

Figure 2:
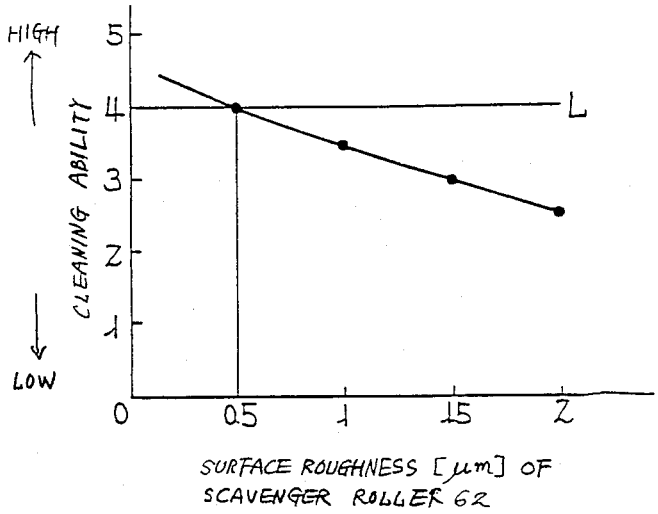
FIG. 2 is a graph showing a relationship between the surface roughness of a scavenger roller and the cleaning ability attainable with the device FIG. 1.

In the light of the above, in illustrative embodiment, the surface condition of the scavenger roller 62 is improved such that the surface roughness becomes less than 0.5 μm. FIG. 2 shows a relationship between the surface roughness of the scavenger roller 62 and the cleaning ability attainable therewith. As shown, assuming an allowable lower limit L of cleaning ability, surface roughness which is lower than 0.5 μm suffices. To improve the surface condition of the scavenger roller 62, the surface of the roller 62 may be polished, coated, plated, or covered with a tube by way of example. Improving the surface condition of the scavenger roller 62 as stated suffices to eliminate incomplete cleaning due to paper dust. Another advantage attainable with the improved surface condition of the scavenger roller 62 is that the wear of the edge **66*a* of the scraper 66** is suppressed. For these reasons, desirable cleaning ability is maintained a long period of time.

As shown in FIG. 1, the cleaning device 50 is provided with a first flicker 76 and a second flicker 78 for removing the residual toner 56 and paper dust from the fur brush 58, in addition to or independently of the scavenger roller 62. Specifically, the first flicker 76 is disposed in and integrally with the casing 68 to extend in parallel to and throughout the length of the axis of the fur brush 58. Likewise, the second flicker 78 extends in parallel to and throughout the length of the axis of the fur brush 58 at a position downstream of the first flicker 76 with respect to the direction of rotation of the fur brush 58. The flicker 78 is supported by opposite side walls, not shown, of the cleaning device 50. Both of the flickers 76 and 78 are so arranged as to penetrate to the fur brush 58. The distance between the flickers 76 and 78 is selected to be greater than such a distance that causes the hairs of the fur brush 58 laid by the flicker 76 to hit against the flicker 78 regainint their original position due to its own elasticity. For example, assuming that the fur brush 58 is 21 mm in diameter, 5 mm in the length of its hairs, and rotated at a speed of 260 r.p.m., a circumferential distance of approximately 10 mm is necessary between the flickers 76 and 78 for the hairs laid by the flicker 76 to rise again by elasticity.

As regards the amount of penetration of the flickers 76 and 78 and that of the scavenger roller 62 to the fur brush 58, if it is greater than 1.5 mm, the torque needed for the rotation of the fur brush 58 is increased and, if it is smaller than 0.5 mm, the cleaning ability is somewhat degraded. Hence, taking account of the deformation of the hairs of the brush 58 due to aging, the amount of penetration of the flickers 76 and 78 under the initial condition should preferably be approximately 1.5 mm. Experiments showed that whether the amounts of penetration of the flickers 76 and 78 and scavenger roller 62 are the same, sequentially increased or sequentially decreased does not have noticeable influence on the performance.

It is necessary that the flickers 76 and 78 be located below the axis of the fur brush 58 ad slightly spaced from the periphery of the drum 12. For example, when two flickers are used as shown in FIG. 1, they need only to be spaced from each other by approximately 10 mm along the circumference of the fur brush 58. When three flickers are used, all that is required is disposing a third flicker at the intermediate between the first and second flickers which are located at the opposite ends of the allowable range. It is to be noted that while the distance between the flickers 76 and 78 and the distance between the flickers 76 and 78 and the scavenger roller 62 should preferably be greater than approximately 10 mm, a decrease in the distance does not cause the performance to be degraded to a noticeable degree.

Whether the flickers 76 and 78 are grounded or not with respect to potential does not essentially affect their function.

If desired, the scavenger roller 62 may be provided with an undulatory surface, or gear-like surface, in order to use the individual undulations, or teeth, for a flicker.

As described above, the two or more flickers 76 and 78 and the scavenger roller 62 cooperates to remove substantially all the residual toner 56 and paper dust from the fur brush 58 with no regard to the amount of toner 56 remaining on the drum 12. This reduces the amount of toner 56 and paper dust transported toward the edge of the cleaning blade 60 and, thereby, the amount of toner allowed to leak through and scatter from the cleaning blade 60. Also, black stripes ascribable to the paper dust are eliminated.

As stated earlier, a cleaning bias voltage is applied from the bias power source 64 to the scavenger roller 62. The bias power source 64 is implemented with an AC power source to apply an AC bias voltage to the scavenger roller 62. This is because a DC bias voltage heretofore applied to the scavenger roller 62 as a cleaning bias voltage prevents residual toner and paper dust of the opposite polarity from being collected, as previously discussed. In the case that an AC bias voltage is applied to the scavenger roller 62 as stated, there may arise some questions, e.g., although residual toner of negative polarity may be collected so long as the polarity of the scavenger roller is positive, what about the next moment when the polarity turns into negative, i.e., if the collection can be completed despite a decrease in electrostatic adhesion or if the toner can be prevented from being scattered despited electrostatic repulsion, and if the potential of the bias voltage can be substantially prevented from becoming zero despite a high frequency.

The above doubts were resolved by experiments in which a positive DC bias voltage and a 500 V, 400 Hz Ac voltage were individually applied to a scavenger roller. Specifically, as regards the cleaning ability of the fur brush and the scattering of toner, substantially the same result was achieved with the DC bias and the AC bias. As for the collection of paper dust, on the other hand, while the DC bias voltage was found to noticeably increase the amount of uncollectable paper dust when the number of copy sheets reached 200 to 300, the AC bias voltage maintained it zero even when the number of copy sheets exceeded 2000. It will therefore be seen that applying an AC bias voltage to the scavenger roller promotes sure collection of paper dust.

Figure 3:
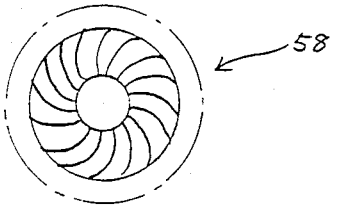
FIG. 3 PRIOR ART
FIG. 3 is a view useful for explaining a drawback particular to a prior art fur brush.

As shown in FIG. 1, the fur brush 58 is affected by a force which constantly lays the hairs of the fur brush 58 in the same direction while they remain in contact with the drum 12 and the flickers 76 and 78. Hence, after a long time of operation, the hairs become deformed in the direction in which they are laid. Further, in a prior art device, the fur brush 58 and the scavenger roller 62 are rotated in the same direction, i.e., they are rotated in the opposite directions to each other at a point where they make contact so that their relative velocity and, therefore, their contact area is increased. This is because increasing the area over which the scavenger roller 62 makes contact with the fur brush 58 is expected to enhance efficient collection of residual toner from the fur brush 58. Eventually, the hairs of the fur brush 58 become unable to restore their original position due to the force stated above. More specifically, as shown in FIG. 3, the outside diameter of the fur brush 58 defined by the hairs thereof becomes smaller than one before the deformation which is indicated by a dash-and-dot line in the figure. As a result, the degree of contact, or area of contact, of the fur brush 58 with the drum 12 is reduced to critically lower the cleaning ability. In addition, the amount of contact of the fur brush 58 deformed so with the scavenger roller 62 is reduced preventing the residual toner on the fur brush 58 from being sufficiently collected by the scavenger roller 62.

In the illustrative embodiment, such a problem is solved by rotating the fur brush 58 and the scavenger roller 62 in opposite directions to each other. In FIG. 1, such directions of rotation of the fur brush and scavenger roller 62 are indicated by arrows. Specifically, in FIG. 1, the fur brush 58 is rotated counterclockwise and the scavenger roller 62 clockwise, and the peripheral speed $v_{58}$ of the fur brush 58 is selected to be higher than the peripheral speed $v_{62}$ of the scavenger roller 62. In this condition, the direction in which the hairs of the brushes 58 are deformed in contact with the drum 12 and the direction in which they are deformed in contact with the scavenger roller 62 are opposite to each other, i.e., the hairs are prevented from being deformed in one direction only. It was proved by experiments that when the peripheral speed $v_{62}$ of the scavenger roller 62 lies in a range which is equal to to four times higher than the peripheral speed $v_{58}$ of the fur brush 58, the fur brush 58 is effectively prevented from being deformed and attains two times longer service life than usual.

Figure 4:
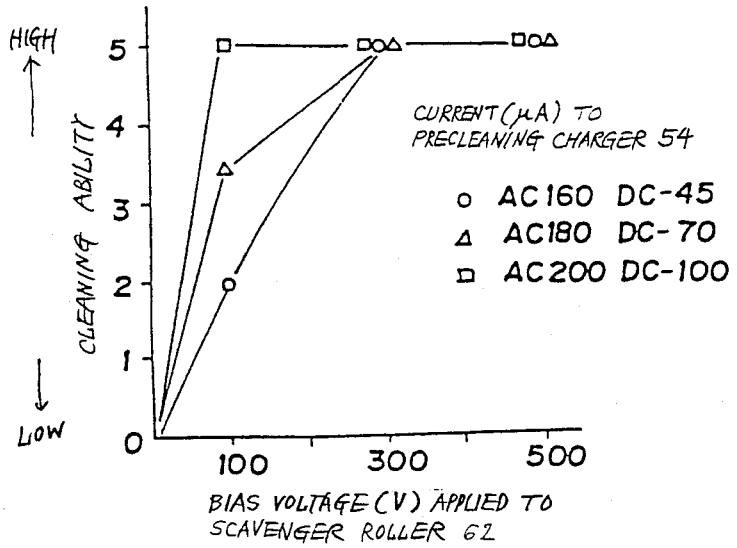
FIG. 4 is a graph showing the relationship between a cleaning bias voltage applied to the scavenger roller, a current applied to a precleaning charger, and a cleaning ability.

The cleaning ability of the fur brush 58 itself was also determined by experiments. Specifically, when the cleaning ability of the fur brush 58 was measured by using the bias voltage (V) applied to the scavenger roller 62 and the current ($\mu$A) fed to the precleaning charger 54 as parameters, a result shown in FIG. 4 was obtained. It will be seen from FIG. 4 that if at least the bias voltage applied to the scavenger roller 62 is higher than 300 V, an extremely high cleaning ability is achievable.

In accordance with the present invention, since the fur brush 58 and the scavenger roller 62 are constructed and operated as stated above, the residual toner of the drum 12 can be removed with extremely high efficiency. Hence, the amount of residual toner transported by the drum 12 as far as the cleaning blade 60 is considerably small, reducing the load on the cleaning blade 60. Nevertheless, when hardly any toner is present on the drum 12, the frictional force acting between edge of the cleaning blade 60 and the surface of the drum 12 is undesirably increased to aggravate the wear of the edge of the cleaning blade 60 and, in the worse case, causes the surface of the drum 12 to be scratched. In the light of this, the cleaning device 50 is controlled as follows. It is to be noted that the words "effective image area" on the drum 12 which will appear refer to that area of the drum 12 which is exposed to image light representative of an entire document, i.e., image and background, and the words "ineffective image area" refer to the other area of the drum 12 which is not exposed imagewise at all. The control is such that when the effective image area is moved through the cleaning device 50 to be cleaned, it is cleaned under a usual cleaning condition to effectively remove the residual toner while, when the ineffective image area is to be cleaned, the function of the precleaning charger 54 and the application of the bias voltage to the scavenger roller 62 are interrupted to allow a part of the residual toner 56 on the drum 12 to reach the cleaning blade 60 to thereby reduce the frictional force acting between the drum 12 and the edge of the cleaning blade 60. Despite such a control, there may occur that the amount of residual toner in the ineffective image area of the drum 12 is short. In such a case, the bias voltage applied to the developing sleeve 32 of the developing device 30 may be interrupted for a predetermined period of time.

Figure 5:
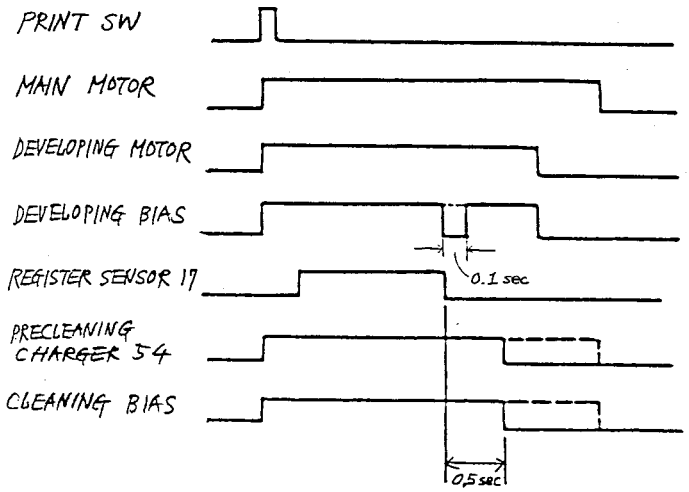
FIG. 5 is a timing chart representative of the timing for applying the cleaning bias voltage to the scavenger roller and that for applying a developing bias voltage to a developing sleeve.

The unique control as stated above will be described in detail with reference to FIG. 5. As shown in FIG. 5, the application of bias voltage to the developing sleeve 32 is interrupted for 0.1 second (in this case) from the instant when the trailing end of a paper sheet has moved past the register sensor 17. Upon the lapse of this period of time, the application of bias voltage to the developing sleeve 32 is resumed. Thereafter, when a motor, not shown, adapted to drive the developing sleeve 32 and others of the developing device 30 is deenergized, the application of bias voltage is stopped. As regards the operation of the precleaning charger 54 and the bias voltage applied to the scavenger roller 62, they are interrupted upon the lapse of 0.5 second after the movement of the trailing end of a paper sheet past the register sensor 17, as shown in FIG. 5. Such a control is effected with the last one of a plurality of paper sheets in a continuous copy mode (naturally, with each paper sheet in a single copy mode), but it is not effected at all when a pattern is to be formed in the ineffective image area of the drum 12 (usually, once per five paper sheets).

In summary, it will be seen that the present invention provides a cleaning device capable of surely removing toner and paper dust from a fur brush even if a large amount of toner is deposited on a photoconductive element and, therefore, on the fur brush. The device, therefore, eliminates scattering of toner otherwise caused at a position downstream of the device to lower image quality, and black stripes otherwise produced on a copy sheet by paper dust.

Various modifications will become possible for those skilled in the art after receiving the teachings of the present disclosure without departing from the scope thereof.

What is claimed is:

1. A cleaning device installed in an electrophotographic recorder for removing residual toner which remains on a surface of a rotatable image carrier for carrying an electrostatic latent image thereon, comprising:

fur brush means rotatable in a predetermined direction in contact with said surface of said image carrier for removing the residual toner;

scavenger roller means rotatable in a predetermined direction in contact with said fur brush means for collecting said residual toner from said fur brush means;

scraper means held in contact with said scavenger roller means for scraping off said residual toner collected;

a precleaning charger for precharging said residual toner on the surface of the image carrier;

cleaning blade means located downstream of said fur brush means with respect to an intended direction of rotation of the image carrier for removing said residual toner from the surface of said imager carrier; and a cleaning bias means for applying a cleaning bias voltage to said scavenger roller means, precharging by said precleaning charger and application of said cleaning bias by said cleaning bias means being interrupted immediately after an effective image area on said surface of said image carrier has been cleaned.

2. A cleaning device as claimed in claim 1, wherein said scavenger roller means has surface roughness of not greater than substantially 0.5 $\mu$m.

3. A cleaning device as claimed in claim 1, further comprising at least two flicker means for shaking down said residual toner from said fur brush means.

4. A cleaning device as claimed in claim 1, wherein said predetermined direction of rotation of said scavenger roller means and said predetermined direction of rotation of said fur brush means are opposite to each other.

5. A cleaning device as claimed in claim 4, wherein a peripheral speed of said scavenger roller means is higher than a peripheral speed of said fur brush means at a position where said scavenger roller means and said fur brush means make contact with each other.

6. A cleaning device as claimed in claim 1, wherein said cleaning bias voltage is an AC bias voltage.

7. A cleaning device as claimed in claim 6, wherein said AC bias voltage includes a DC bias component.

8. A cleaning device as claimed in claim 1, wherein said scavenger roller means is constituted by a conductive member.

9. A cleaning device as claimed in claim 1, wherein said scavenger roller means comprises a conductive member which is coated with an insulating film.

10. A cleaning device as claimed in claim 1, wherein said scavenger roller means is provided with an undulatory surface for removing said residual toner from said fur brush means in contact with said fur brush means.

11. A cleaning device as claimed in claim 1, wherein said cleaning device is controlled together with developing means to which a developing bias voltage is applied, such that application of said developing bias is interrupted for a predetermined period of time immediately after an effective image area on said surface of said image carrier has been developed.

* * * * *